US005984100A

United States Patent [19]

Ramsey et al.

[11] Patent Number: 5,984,100

[45] Date of Patent: Nov. 16, 1999

[54] DECORATIVE PEDESTAL FOR STORING BATHROOM ACCESSORIES

[76] Inventors: Mark Ramsey, 6618 Hawksnest, Charlotte, N.C. 28269; Jack E. Hagerup, 921 Holly Creek Dr., Great Falls, Va. 22066

[21] Appl. No.: 09/228,825

[22] Filed: Jan. 12, 1999

Related U.S. Application Data

[60] Provisional application No. 60/071,015, Jan. 13, 1998.

[51] Int. Cl.[6] ..... B65D 69/00

[52] U.S. Cl. ..... 206/581; 200/361; 312/206

[58] Field of Search ..... 206/15.2, 15.3, 206/361, 362.2, 362.3, 581; 211/65, 66; 312/206

[56] References Cited

U.S. PATENT DOCUMENTS

| | | | |
|---|---|---|---|
| D. 356,893 | 4/1995 | Conmy . | |
| 2,697,646 | 12/1954 | Craig | 206/361 |
| 4,008,933 | 2/1977 | Wanek | 312/206 |
| 4,033,650 | 7/1977 | Alissandratos | 312/206 |
| 4,211,750 | 7/1980 | Gillespie . | |
| 4,415,211 | 11/1983 | Alissandratos | 312/206 |
| 5,305,882 | 4/1994 | Kaplan . | |

*Primary Examiner*—David T. Fidei
*Attorney, Agent, or Firm*—Christopher C. Dremann, PC; Christopher C. Dremann

[57] ABSTRACT

A decorative bathroom furnishing to be placed in a bathroom provides concealed, sanitary storage of bathroom accessories and cleaning supplies, such as a toilet plunger, a toilet cleaning brush, a pair of rubber gloves and a roll of toilet tissue. The bathroom accessories and cleaning supplies are located in a hollow chamber defined by the bathroom furnishing. Access to the bathroom accessories and cleaning supplies is provided through a door section. A hook is provided for hanging the toilet cleaning brush. An upwardly depending post on a cantilevered shelf, or alternatively, an inwardly depending post, is provided to hold the paper core of the roll of toilet tissue. The base assembly of the bathroom furnishing is provided with an angled drainage grate having a plurality of holes therethrough positioned over a cavity which serves as a catch basin. The toilet plunger rests on the grate such that the catch basin collects moisture from the bathroom accessories and cleaning supplies, and in particular, residual toilet water from the toilet plunger and the toilet cleaning brush. An absorbent, deodorizing and disinfecting sponge may also be placed on the floor of the catch basin to collect, deodorize and disinfect moisture from the bathroom accessories and cleaning supplies. A clip is provided on the door section to hold the pair of rubber gloves. The exterior design of the bathroom furnishing can be adapted to take on the aesthetic appearance of, for example, a Corinthian or Roman column, a castle, a fish tank, a tree stump, a golf bag or the like. In addition, the top surface of the bathroom furnishing can be used as a pedestal for books, a flowerpot, a basket or the like.

10 Claims, 2 Drawing Sheets

DECORATIVE PEDESTAL FOR STORING BATHROOM ACCESSORIES

CROSS REFERENCE TO RELATED APPLICATIONS

This application claims the benefit of United States Provisional Application Ser. No. 60/071,015 filed Jan. 13, 1998.

FIELD OF THE INVENTION

The invention relates generally to a space-saving bathroom furnishing which is decorative, hygienic and conveniently stores common bathroom accessories and cleaning supplies. More particularly, the invention relates to a decorative pedestal for providing compact, concealed, sanitary storage of a toilet plunger, toilet cleaning brush, rubber gloves, one or more rolls of toilet tissue and the like.

BACKGROUND OF INVENTION

In today's society entry hall bathrooms, commonly referred to as "powder rooms," are increasing in popularity. Because they are used primarily by visitors to the home, powder rooms are generally smaller in square footage than a conventional bathroom and are typically furnished with only a toilet, sink and mirror. Despite their smaller size, powder rooms require the same number and kind of bathroom accessories and cleaning supplies as a conventional bathroom. At the same time, there is a resurgence in the use of "pedestal" style sinks that do not include an underneath cabinet, particularly in powder rooms. This may be due partly to their aesthetic attributes and partly to the fact that the openness of the pedestal sink creates the illusion that the powder room is larger than it really is. Regardless, the use of a pedestal sink further compounds the problem of storing the necessary number and kind of bathroom accessories and cleaning supplies in a bathroom that is already diminutive in size. As a result, homeowners have devised ingenious bathroom furnishings for storing unsightly bathroom accessories and cleaning supplies, including decorative chests, baskets, planters and footstools.

Although such furnishings often provide a space-saving and aesthetic solution, they are unsanitary. Toilet bowl plungers and toilet bowl brushes can harbor bacteria and can foster the growth of mold and mildew. After use, these accessories remain moist with residual water from the toilet. Accordingly, they are typically placed on a paper or cloth mat or in the sink until dry before they are placed in the bathroom furnishing for storage. This solution, however, is not only unsightly but is unsanitary as well, particularly in the small confines of the modem day powder room.

The present invention provides an aesthetically pleasing and covert means of storing bathroom accessories and cleaning supplies immediately after use. The residual water runs off the accessories and is collected, absorbed and disinfected in a catch basin. The prior art describes means by which to deodorize runoff toilet water from a toilet brush. There is no prior art, however, that addresses collecting the runoff toilet water, containing the runoff toilet water and disinfecting the inherent bacteria in the runoff toilet water. Nor does the prior art disclose a bathroom furnishing for storing a toilet plunger, toilet cleaning brush, rubber gloves, one or more rolls of toilet tissue and the like that covertly houses these bathroom accessories in a compact, concealed and sanitary manner.

Accordingly, it is a principle object of the present invention to provide a bathroom furnishing for storing bathroom accessories and cleaning supplies in a compact, concealed and sanitary manner.

It is a further, and more particular, object of the present invention to provide a decorative pedestal for compact, concealed and sanitary storage of a toilet plunger, toilet cleaning brush, rubber gloves, one or more rolls of toilet tissue and the like.

It is another, and still more particular, object of the invention to provide a decorative pedestal for storing bathroom accessories and cleaning supplies that includes a means for collecting the residual toilet water, containing the residual toilet water and disinfecting the inherent bacteria in the residual toilet water.

BRIEF DESCRIPTION OF THE DRAWINGS

In view of these and other objects which will become more readily apparent as the nature of the invention is better understood, the invention consists in the novel combination and arrangement of parts hereinafter more fully described, illustrated and claimed with reference being made to the appended drawings in which:

DETAILED DESCRIPTION OF THE PREFERRED EMBODIMENTS

Figure 1:
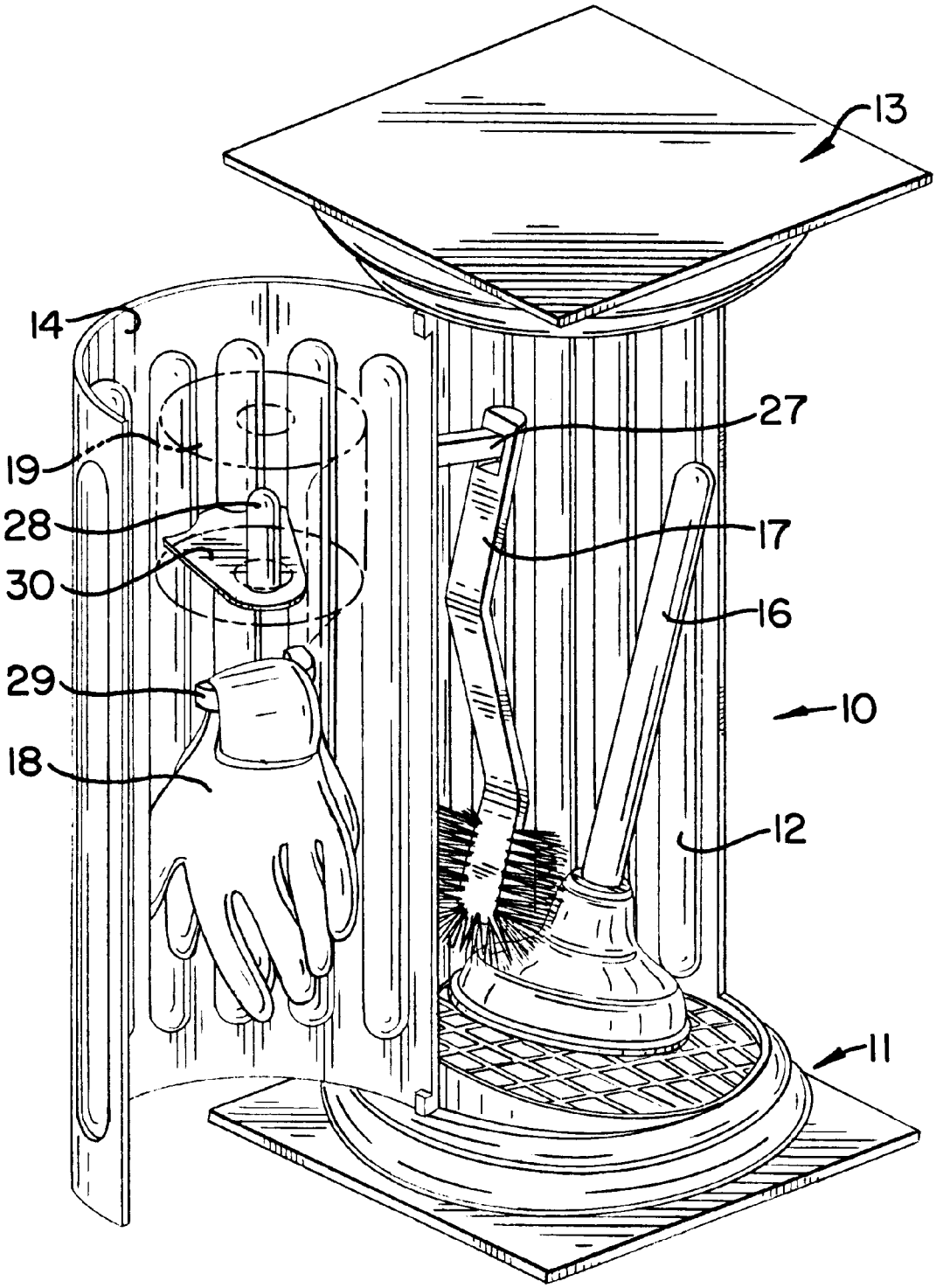
FIG. 1 is a perspective view of a preferred embodiment of a bathroom furnishing according to the invention shown in the open position.

Referring now to the aforementioned figures, a bathroom furnishing 10 according to the invention includes a base assembly 11 intended to rest on the floor, a wall 12 securely fastened at one end to the base assembly 11 and an upper cap assembly 13 securely fastened to the other end of the wall 12. The base assembly 11, the wall 12 and the upper cap assembly are formed to conform to the desired aesthetic appearance of the exterior design of the bathroom furnishing 10. A door section 14 of the wall 12 is hinged along its vertical edge 15 such that the door section 14 can be pivoted about the vertical edge 15 between a closed position and an open position shown in FIG. 1. Accordingly, door section 14 provides access to the bathroom accessories and cleaning supplies stored within the hollow chamber defined by the bathroom furnishing 10.

Figure 2:
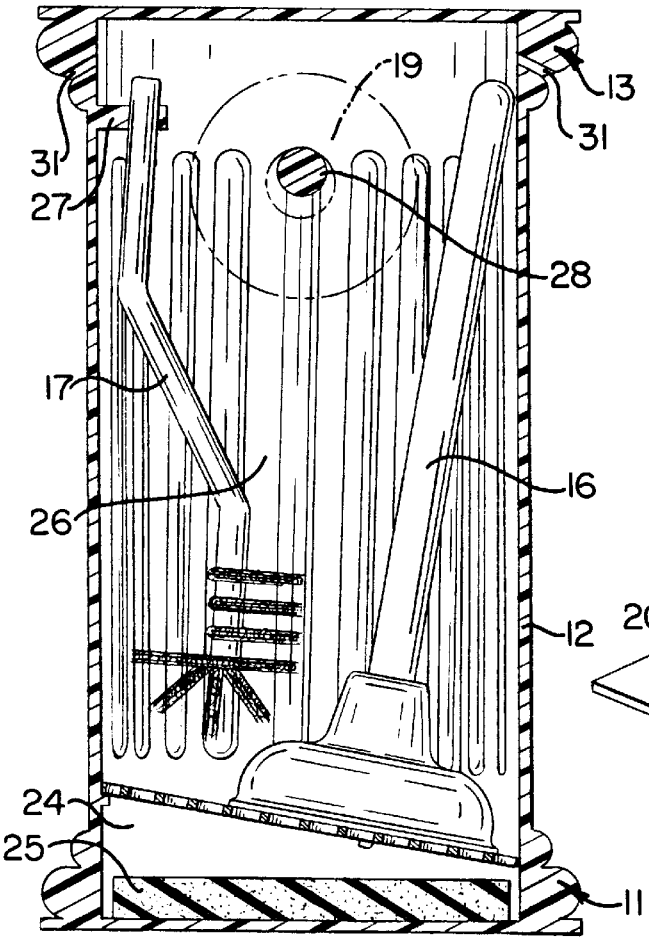
FIG. 2 is a vertical cross-section of the bathroom furnishing of FIG. 1 illustrating a preferred embodiment of the position of the bathroom accessories and cleaning supplies within the bathroom furnishing.

In the preferred embodiments illustrated in FIGS. 1 and 2, the bathroom accessories and cleaning supplies are a toilet plunger 16, a toilet cleaning brush 17, a pair of rubber gloves 18 and a roll of toilet tissue 19. However, the bathroom accessories and cleaning supplies may include any non-decorative items commonly used in the bathroom that can be conveniently stored within the bathroom furnishing 10, such as an extra bar of soap, a spray bottle of glass cleaner, a can of scouring cleanser or a cleaning rag. As shown in FIG. 1, the toilet plunger 16 and the toilet cleaning brush 17 may be located within the hollow chamber defined by the bathroom furnishing 10, and the rubber gloves 18 and the roll of toilet tissue 19 may be located on the door section 14 of the wall 12. As shown in FIG. 2, the roll of toilet tissue may alternatively be located within the hollow chamber defined by the bathroom furnishing 10.

Figure 3:
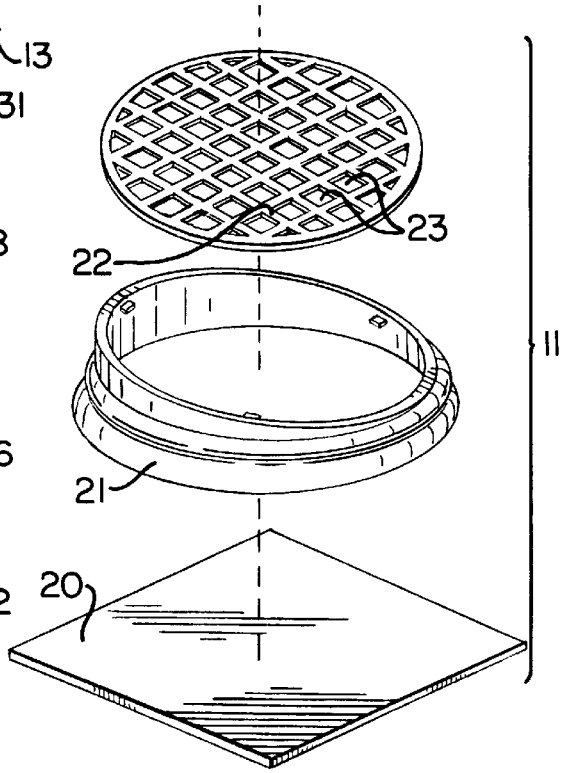
FIG. 3 is an exploded view of a preferred embodiment of the base section of the bathroom furnishing of FIG. 1.

As best illustrated in FIG. 3, the base assembly 11 has a number of specific features. Regardless of its exterior shape, base assembly 11 incorporates at least three parts, namely a base plate 20, a ring 21 and a grate 22. The base plate 20 is preferably planar so that the bathroom furnishing 10 rests securely on the bathroom floor. The ring 21 is secured to base plate 20 and depends outwardly from one side of the base plate 20. The ring 21 is preferably cylindrical, but may be any shape such that the base plate 20 and the ring 21 conform to the desired aesthetic appearance of the exterior design of the bathroom furnishing 10. The grate 22 is positioned on the ring 21 at an angle of less than about thirty degrees relative to the base plate 20. The angle is such that a standard toilet plunger 16, when rested on grate 22, is oriented relative to the vertical as illustrated in FIG. 2. Further, grate 22 has holes 23 formed therethrough as best shown in FIG. 3 for a purpose to be described.

Figure 4:
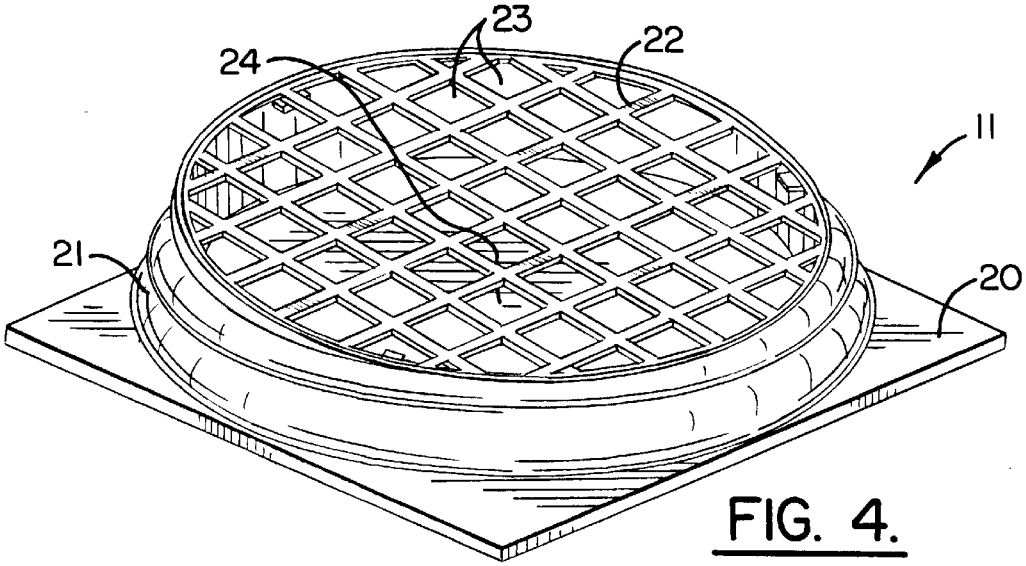
FIG. 4 is a perspective view of the base section of FIG. 3.

As best shown in FIG. 2 and FIG. 4, the union of base plate 20, ring 21 and grate 22 define a cavity 24 of base assembly 11. The function of the holes 23 in grate 22 of the base assembly 11 is to allow moisture from the bathroom accessories and cleaning supplies 16, 17 and 18, and in particular residual toilet water, to pass through grate 22 and into the cavity 24 of base assembly 11. Preferably, an absorbent, deodorizing and disinfecting sponge 25 is placed within the cavity 24 to collect, deodorize and disinfect moisture from the bathroom accessories and cleaning supplies 16, 17 and 18, until it has evaporated. The sponge 25 may, for example, be formulated or treated with an antimicrobial agent or other disinfectant which deodorizes and disinfects the moisture as it is collected and absorbed into the pores of the sponge 25.

The wall 12 is securely fixed at its inferior end to base assembly 11 and at its superior end to upper cap assembly 13. As previously mentioned, wall 12 is formed to conform to the desired aesthetic appearance of the exterior design of the bathroom furnishing 10. Accordingly, the wall 12 may have any shape, but preferably is generally cylindrical, as shown, for a purpose to be described. The door section 14 of wall 12 is hinged along its vertical edge 15 such that it can be pivoted about the vertical edge 15 to the open position illustrated in FIG. 1, thereby providing access for storing and retrieving the bathroom accessories and cleaning supplies 16, 17, 18 and 19 positioned within a cavity 26 defined by the base assembly 11, wall 12 and upper cap assembly 13 of the bathroom furnishing 10.

As shown in FIG. 1 and FIG. 2, a hook post 27 depends inwardly and generally perpendicularly from the interior surface of the wall 12 adjacent the upper cap assembly 13. Preferably, the hook post 27 extends inwardly at a slight upward angle relative to the horizontal. The location and dimensions of the hook post 27 are such that a conventional toilet cleaning brush 17 can be hung by a hole provided in its handle. As shown in FIG. 1, a post 28 depends upwardly and generally perpendicularly from a cantilevered support shelf 30 affixed to the interior surface of the door section 14 of wall 12. Alternatively, as shown in FIG. 2, the post 28 depends inwardly and generally perpendicularly from the interior surface of the wall 12 in the direction of the door section 14. In the preferred embodiment illustrated in FIG. 1, the post 28 preferably extends upwardly at a slight inward angle to the vertical. In the preferred embodiment illustrated in FIG. 2, the post 28 preferably extends inwardly at a slight upward angle relative to the horizontal. The location and dimensions of post 28 are such that the paper core of at least one conventional roll of toilet tissue 19 rests on post 28 and does not interfere with the space available for the remaining bathroom accessories and cleaning supplies 16, 17 and 18. A clip 29 is also affixed to the interior surface of door section 14 as shown in FIG. 1. The space between the clip 29 and the interior surface of door section 14 is sufficient such that a conventional pair of rubber gloves 18 is securely retained between the clip 29 and the interior surface of the door section 14 of the wall 12.

The upper cap assembly 13 is secured to the superior end of the wall 12. Preferably, the upper cap assembly 13 is formed in one piece and, as previously mentioned, is formed to conform to the desired aesthetic appearance of the exterior design of the bathroom furnishing 10. Ventilation holes 31 are provided in upper cap assembly 13 as shown in FIG. 2 such that the cavity 26 of the bathroom furnishing 10 is in fluid communication with the ambient atmosphere, thereby permitting air to flow between the cavity 26 and the ambient atmosphere. Thus, the moisture from the bathroom accessories and cleaning supplies, and in particular the residual toilet water, will evaporate more rapidly than if the cavity 26 was closed to the ambient atmosphere.

The base assembly 11, wall 12 and upper cap assembly 13 of the bathroom furnishing 10 may be made from any lightweight, sturdy material. Preferably, however, the components of the bathroom furnishing 10 are each made of a moldable polymer resin. More preferably, the moldable polymer resin is formulated, impregnated, coated or sprayed with a long-lasting antimicrobial agent. A suitable antimicrobial agent is disclosed in U.S. Pat. No. 5,238,749 issued Aug. 24, 1993, to Cueman et al. entitled ANTIMICROBIAL COATING PROCESS AND PRODUCT, the disclosure of which is expressly incorporated herein. As disclosed therein, the antimicrobial agent preferably comprises a chlorinated phenol, such as 5chloro-2-(2,4 dichloro-phenoxy) phenol. Regardless, the antimicrobial agent inhibits the harboring of bacteria and the growth of mold and mildew within the bathroom furnishing 10.

It should be noted that the invention disclosed herein provides a bathroom furnishing for storing bathroom accessories and cleaning supplies in a compact, concealed and sanitary manner. More particularly, the invention to provides a decorative pedestal for compact, concealed and sanitary storage of a toilet plunger, toilet cleaning brush, rubber gloves, one or more rolls of toilet tissue and the like. In addition, the bathroom furnishing described and disclosed herein includes the following notable features: (1) a single door for easy access to the bathroom accessories and cleaning supplies stored inside; (2) easy removal of each bathroom accessory and cleaning supply without disturbing the remaining bathroom accessories and cleaning supplies; (3) a built-in catch basin for collecting moisture, such as residual toilet water, from the bathroom accessories and cleaning supplies after use; (4) an absorbent, deodorizing and disinfecting sponge on the floor of the catch basin that is activated by moisture from the bathroom accessories and cleaning supplies; (5) a decorative exterior design that can be adapted to take on the aesthetic appearance of, for example, a Corinthian or Roman column, a castle, a fish tank, a tree stump, a golf bag or the like; (6) a top surface that can be used as a pedestal for books, flowers, a basket and the like; and (7) a versatile configuration that can be adapted for use in other applications such as a plant stand with a cavity for storing horticulture accessories.

It is to be understood that the forgoing description and specific embodiments shown herein are merely illustrative of the best mode of the invention and the principals thereof, and that various modifications and additions may be made to the apparatus by those skilled in the art without departing from the spirit and scope of the invention, which is intended to be limited only by the scope of the appended claims. For example, but without limitation, it should be noted that the bathroom furnishing made be made of any material and in any configuration to achieve the principle objects of the invention disclosed hereinabove.

That which is claimed is:

1. A decorative bathroom furnishing defining a hollow chamber for storing bathroom accessories and cleaning supplies, said bathroom furnishing comprising a base assembly comprising a generally planar base plate;

an annular ring secured to said base plate; and a grate having a plurality of holes formed therethrough, said grate positioned on said annular ring such that said base plate, said annular ring and said grate define a cavity within said base assembly;

a wall comprising a first end secured to said base assembly and a second end opposite said first end, said wall comprising a door section movable between a closed position and an open position for providing access to the hollow chamber defined by the bathroom furnishing; and an upper cap assembly secured to said second end of said wall.

2. The bathroom furnishing of claim 1 wherein said grate is positioned on said annular ring at an angle relative to said planar base plate of less than about 30 degrees.

3. The bathroom furnishing of claim 1 wherein said base assembly further comprises a sponge placed within the cavity defined by said base plate, said annular ring and said grate to collect, deodorize and disinfect moisture from the bathroom accessories and cleaning supplies.

4. The bathroom furnishing of claim 3 wherein said sponge comprises an antimicrobial agent for deodorizing and disinfecting the moisture from the bathroom accessories as the moisture is collected by said sponge.

5. The bathroom furnishing of claim 1 wherein said upper cap assembly has at least one ventilation hole formed therethrough such that the hollow chamber defined by the bathroom furnishing is in fluid communication with the ambient atmosphere.

6. The bathroom furnishing of claim 1 wherein the bathroom accessories and cleaning supplies are selected from the group consisting of a toilet plunger, a toilet cleaning brush, a pair of rubber gloves and at least one roll of toilet tissue.

7. The bathroom furnishing of claim 1 wherein at least one of said base assembly, said wall and said upper cap assembly is made of a moldable polymer resin comprising an antimicrobial agent.

8. The bathroom furnishing of claim 7 wherein said antimicrobial agent comprises a chlorinated phenol that inhibits the harboring of bacteria and the growth of mold and mildew within the bathroom furnishing.

9. The bathroom furnishing of claim 1 wherein said ring of said base assembly is generally cylindrical, said wall is generally cylindrical and said upper cap assembly is generally cylindrical.

10. The bathroom furnishing of claim 1 wherein the exterior design of the bathroom furnishing is selected from the group consisting of a Corinthian column, a Roman column, a castle, a fish tank, a tree stump and a golf bag.

* * * * *